United States Patent [19]

Shattuck

[11] Patent Number: 4,547,088

[45] Date of Patent: Oct. 15, 1985

[54] CORRECTABLE THERMAL TRANSFER PRINTING RIBBON

[75] Inventor: Meredith D. Shattuck, Hollister, Calif.

[73] Assignee: International Business Machines Corporation, Armonk, N.Y.

[21] Appl. No.: 163,351

[22] Filed: Jun. 26, 1980

[51] Int. Cl.[4] ..... B41J 31/00

[52] U.S. Cl. ..... 400/241.1; 400/120; 400/240.1; 400/696; 428/913; 427/148

[58] Field of Search ..... 400/118, 119, 120, 234, 400/240, 240.1, 240.2, 240.4, 241, 241.1, 241.2, 241.4, 696, 697, 697.1; 428/474.4, 913; 427/146, 147, 148, 149, 153

[56] References Cited

U.S. PATENT DOCUMENTS

| | | | |
|---|---|---|---|
| 2,188,590 | 1/1940 | Bjorksten et al. | 400/241.1 X |
| 2,671,734 | 3/1954 | Rosenblum | 400/237 |
| 3,007,829 | 11/1961 | Akkeron | 427/148 X |
| 3,017,297 | 1/1962 | Newman et al. | 427/153 X |
| 3,293,650 | 12/1966 | Buros | 400/696 X |
| 3,480,500 | 11/1969 | Hotter | 400/241.1 X |
| 3,519,456 | 7/1970 | Reed et al. | 400/241.1 X |
| 3,704,150 | 11/1972 | Barouh et al. | 400/697 X |
| 3,744,611 | 7/1973 | Montanari et al. | 400/120 |
| 3,825,437 | 7/1974 | Blair | 428/474.4 |
| 3,825,470 | 7/1974 | Elbert et al. | 428/474.4 |
| 3,924,728 | 12/1975 | Brown et al. | 400/696 |
| 3,942,621 | 3/1976 | Karlan | 400/697 |
| 4,093,772 | 6/1978 | Taylor et al. | 400/696 X |
| 4,161,551 | 7/1979 | Barouh et al. | 400/237 X |
| 4,166,706 | 9/1979 | Korpman | 400/696 |
| 4,239,832 | 12/1980 | Barouh et al. | 400/237 X |
| 4,242,402 | 12/1980 | Korpman | 400/696 X |

FOREIGN PATENT DOCUMENTS

| | | | |
|---|---|---|---|
| 2035408 | 6/1980 | United Kingdom | 400/696 |

OTHER PUBLICATIONS

IBM Technical Disclosure Bulletin, "Heat Set Correctable Ribbon," Findlay, vol. 20, No. 9, Feb. 1978, pp. 3549–3552.

*Primary Examiner*—Ernest T. Wright, Jr.
*Attorney, Agent, or Firm*—Joseph G. Walsh

[57] ABSTRACT

The ink layer of a thermal transfer printing ribbon is overcoated with a hold-off layer which serves to make the resulting printing more easily correctable. The hold-off layer operates by preventing penetration by the ink layer into the substrate being printed upon.

1 Claim, 1 Drawing Figure

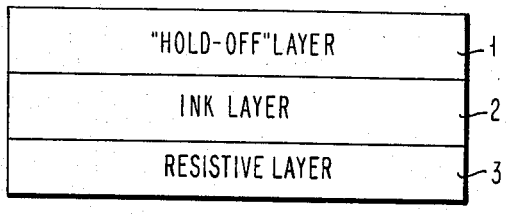
"HOLD-OFF" LAYER
1
INK LAYER
2
RESISTIVE LAYER
3

CORRECTABLE THERMAL TRANSFER PRINTING RIBBON

DESCRIPTION

1. Technical Field

The present invention relates to ribbons to be used in thermal transfer printing. In particular, it relates to ribbons wherein the resulting printing is more easily corrected than has previously been possible. The ink layer of the ribbons is covered with a hold-off layer. During the printing operation, the hold-off layer comes into contact with the substrate being printed upon, for example, paper. The ink layer is simultaneously transferred with the hold-off layer. The hold-off layer is thus deposited on the paper beneath the ink layer. The hold-off layer serves to make subsequent correction of the printing easier by preventing the ink from penetrating into the pores of the substrate paper being printed upon. There are now two ways in which subsequent ink removal can be achieved: (1) the hold-off layer can either be made of fracture easily within itself leaving some portion of itself on the paper, or (2) materials can be chosen wherein the interface between the hold-off layer and the ink layer serves as a point of fracture between the ink and the hold-off layer. In this second case the hold-off layer remains on the paper.

By use of the ribbons of the present invention comprising hold-off layers, it is possible to correct the resulting printing by erasing procedures which involve rubbing or abrading and also by lift-off procedures in which the printing is removed by adhering to an applied sticky material which is then lifted off.

2. Background Art

As far as I am aware, nothing in the prior art describes a thermal transfer printing ribbon containing a hold-off layer.

U.S. Pat. Nos. 2,188,590 and 2,671,734 both deal with carbon paper containing an overcoating to prevent smudging. This overcoating is intended to operate before the printing operation. The patents do not mention thermal transfer printing.

U.S. Pat. No. 3,293,650 describes a printing operation wherein a layer of material is first applied to facilitate subsequent removal by use of a solvent. It does not show the simultaneous application of a hold-off layer and ink, and does not show the structure of the present invention. It makes no mention of thermal transfer printing.

DISCLOSURE OF THE INVENTION

Thermal transfer printing is quite well-known in the art. By any of a variety of methods, heat is selectively applied to portions of a ribbon to melt a contiguous ink layer onto the substrate being printed upon which is, of course, usually paper. The present method describes a ribbon configuration which facilitates subsequent correction of the printing.

According to the present invention, the ordinary ink layer is overcoated with a second layer called a hold-off layer. This second layer is called a hold-off layer because it prevents or holds the ink from penetrating into the paper fibers. At the same time, the hold-off layer adheres to the paper sufficiently well so that the paper may be handled, creased and otherwise subjected to ordinary wear without smearing or deterioration of the print quality.

DESCRIPTION OF DRAWING

The accompanying drawing, which is not to scale, shows one preferred embodiment of the present invention.

In the drawing, (1) represents a hold-off layer; (2) represents an ink layer; and (3) represents a resistive layer.

When the expression "ink layer" is used, it is meant to refer to the transfer layer of marking material, which can contain either pigments or dyes or combinations of both. Carbon black is generally the preferred coloring material, and it is present in minute particles. The ink layer (2) contains the marking material either dissolved or suspended in thermoplastic resin. In general, the transfer layer (2) of marking material is from about 1 to 5 microns thick. Several materials are known to be useful as resins in the ink layer (2), and the present invention is suitable for use with all of them.

The hold-off layer (1) comprises thermoplastic material. The selection of optimum material will depend upon the particular substrate, such as paper, being printed upon and also upon the particular ink to be used. The hold-off layer materials should be selected to have the proper thermoplastic properties so that it transfers to the paper at the temperature obtained during printing. Several commercially available thermoplastic materials have given excellent results. The preferred material is poly(ethylene oxide). Good results have also been obtained using methyl vinyl ether/maleic anhydride copolymer, polyvinylpyrrolidone, N-vinylpyrrolidone/vinyl acetate copolymer and poly(ethylene glycol). Satisfactory results were obtained wth N-vinylpyrrolidone/diethylaminomethyl methacrylate copolymer, methyl vinyl ether/maleic acid copolymer, poly(acrylic acid) and poly(vinyl alcohol).

The amount of interaction between the paper and the hold-off layer (1) can be varied by varying the thickness of the hold-off layer (1). In general the hold-off layer (1) has a thickness of from 0.1 to 10 microns, preferably from about 1 to 2 microns.

Using the present invention, good quality print has been obtained. The print was smear proof and also crease resistant. At the same time the print was easily removed by a pressure adhesive (Highland brand tape from 3M Company) without paper fiber tearing or removal. It was also easily removed by mechanical means, such as an ordinary eraser commonly used to erase pencil markings. In fact, the printing from the present invention is in some cases more easily erased than is lead from a pencil.

The correctable thermal transfer printing ribbon of the present invention can be used with a thermal adhesive lift-off technique. The commercially available IBM correcting adhesive tape does a good job of removing print made with the thermal transfer ribbons of the present invention.

The following Examples are given solely for the purpose of illustration and should not be considered limitations on the present invention, many variations of which are possible, without departing from the spirit or scope thereof.

EXAMPLE I

Resistive ribbon printing is a technology which uses a thin resistive layer (3) to produce sufficient heat to melt an adjacent thermoplastic ink layer (2) onto the paper. Printing is obtained by placing a stylus in contact with the resistive layer (3). Current is then passed into the resistive layer (3) generating sufficient heat to soften and transfer the ink to paper. A correctable thermal transfer was achieved by coating the ink layer (2) of a resistive ribbon with a 5% water solution of polyvinylpyrrolidone (PVP). After drying to remove solvent, the ribbon was used to print on paper.

Print was obtained by passing current through the resistive layer (3) as previously described. The PVP coated ink layer (2) was transferred to the paper while the PVP layer (1) prevent penetration of the ink into the paper. Good quality print was obtained which was smear proof. The print, however, could be "erased" by contact with a pressure sensitive adhesive such as Highland brand permanent mending tape. When the adhesive tape was lifted off the printed page, the printed areas under the tape were pulled away from the paper with the tape, leaving a clean unmarked area. The unmarked area could be remarked with print or left clear.

EXAMPLE II

In another example the correctable thermal transfer was achieved by coating the ink layer (2) of a resistive ribbon with a 3% water solution of poly(ethylene oxide). After solvent removal, the thickness of the hold-off layer (1) was about 2 microns. The ribbon was used to print onto paper as in Example I. Very good quality print was obtained. The print was removed from the paper by contact and lift-off with pressure sensitive adhesive tape such as IBM correcting adhesive tape.

EXAMPLE III

The correctable thermal transfer layer (2) was coated with polyvinylpyrrolidone as in Example I. The ribbon was used to print paper. The print was easily removed by mechanical action with a pencil eraser.

I claim:

1. A ribbon for correctable thermal transfer printing, said ribbon comprising an ink layer and on top of said ink layer a thermoplastic hold-off layer which prevents penetration by the ink layer into a substrate being printed upon, wherein the hold-off layer comprises polyvinylpyrrolidone, poly(ethylene oxide), methyl vinyl ether/maleic acid copolymer, N-vinyl pyrrolidone/vinyl acetate copolymer or poly(ethylene glycol).

* * * * *